United States Patent [19]

Bradbury

[11] 4,367,778

[45] Jan. 11, 1983

[54] NAIL DRIVER ACCESSOR HAVING A NAIL HOLDER MECHANISM

[76] Inventor: Ray Bradbury, 500 E. Fairmount Rd., Burbank, Calif. 91501

[21] Appl. No.: 201,429

[22] Filed: Oct. 28, 1980

[51] Int. Cl.[3] ..... B25C 1/02

[52] U.S. Cl. ..... 145/30 R; 145/46

[58] Field of Search ..... 227/147, 156; 7/143, 7/901; 145/46, 30 R, 30 A

[56] References Cited

U.S. PATENT DOCUMENTS

| | | | |
|---|---|---|---|
| 1,646,993 | 10/1927 | Collins | 145/30 R |
| 2,722,251 | 11/1955 | Dillon | 145/30 R |
| 3,125,143 | 3/1964 | Wilson | 145/30 R |
| 3,788,373 | 1/1974 | Aherin | 145/30 R |
| 3,847,193 | 11/1974 | Brunstetter | 227/147 X |
| 3,934,779 | 1/1976 | Dent | 227/147 |

*Primary Examiner*—Howard N. Goldberg

*Assistant Examiner*—Fred A. Silverberg

*Attorney, Agent, or Firm*—Roger A. Marrs

[57] ABSTRACT

A device is disclosed herein for releasably holding a nail so that it may be automatically driven into place by a hammer which includes a circular body portion or base having a central receptacle for insertably receiving the driving or impact head of the hammer. The base further includes an impact plate carried at the bottom of the receptacle having one surface formed to correspond to the striking surface of the hammer impact head and having its opposite surface formed with a curved recess for bearing against the head of a nail. The recess is coaxially disposed with respect to an opening in the base through which the nail extends. A stabilizing portion outwardly projects ahead of the base and includes a yoke for supporting the shank of the nail during the driving procedure.

3 Claims, 3 Drawing Figures

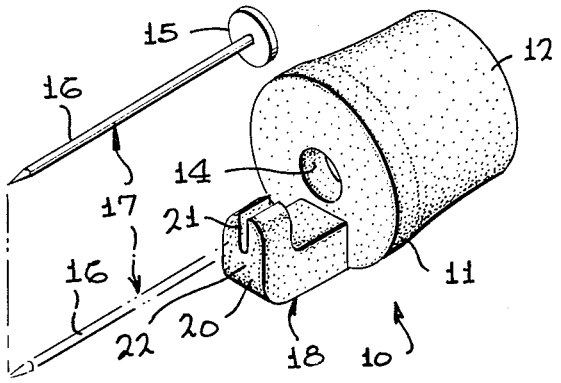
FIG. 1
FIG. 2
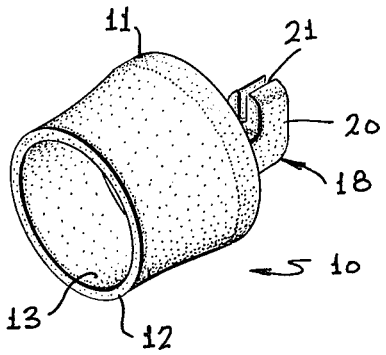
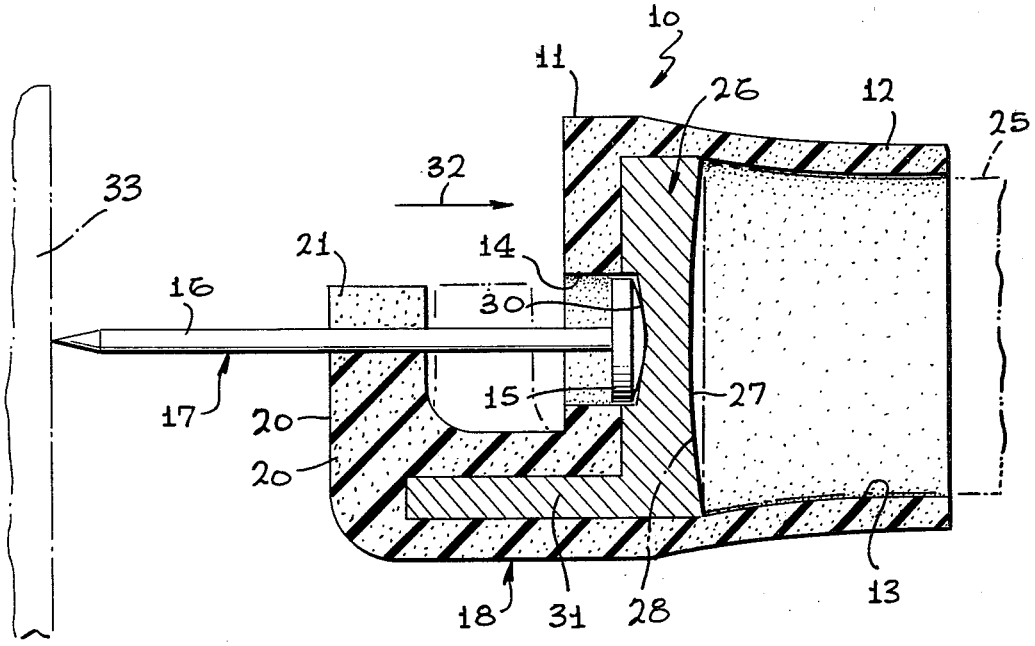
FIG. 3

NAIL DRIVER ACCESSOR HAVING A NAIL HOLDER MECHANISM

BACKGROUND OF THE INVENTION

1. Field of the Invention

This invention relates to nail driving apparatus and more particularly to a novel accessory for holding a nail on the driving or striking head of a hammer so that the nail may be started or centered without the user having to hold the nail.

2. Brief Description of the Prior Art

It has been the conventional practice in a nailing procedure to hold the shank of the nail with the fingers of one hand while the user's other hand holds the hammer and strikes the head of the nail in order to drive the nail into wood or the like. Generally, the user visually aligns the striking path of the hammer head with the head of the nail so that a firm solid impact is imparted to the nail for driving purposes. In most instances, this method is acceptable and has proven to be reasonably fast.

However, problems and difficulties are encountered when the workman or user is attempting to center or drive a nail into a location which is not readily accessible or in which he cannot adequately visually align the swinging travel of the hammer head with the head of the nail. At some construction sights, the workmen must work work on platforms or at elevated heights and where he must lean or hold on to a structure with one hand while nailing and swinging the hammer with the other hand. In this latter instance, he cannot hold or otherwise support the nail for centering or initial driving purposes. Once the nail has been suitably started, then only one hand is required for swinging the hammer. However, during the initial centering and starting phase of the nailing procedure, both hands are normally required. In some instances, the workman may either drill a small hole or punch a small hole into the wood intended to receive the driving nail. This procedure, of course, is time consuming and requires additional tools and operations preceeding the actual driving of the nail.

Therefore, a long standing need has existed to provide a novel nailing accessory which will readily hold the nail onto the hammer as it is swung so that the nail will be suitably started and which can be conveniently achieved as a one hand operation.

SUMMARY OF THE INVENTION

Accordingly, the above problems and difficulties are obviated by the present invention which provides a novel nail driver accessory for releasably holding a nail onto the striking head of a hammer which includes a circular body portion or base formed with a central receptacle at one end for insertably receiving the driving or impact head of the hammer. The base further includes an impact plate carried at the bottom of the receptacle which is formed with a surface on one side corresponding to the striking surface of the hammer impact head and formed on its opposite surface with a curved recess for bearing against the head of a nail. The recess in the plate is coaxially disposed with respect to an opening on the other end of the base through which the nail extends. Stabilizing means is provided on the end of the base opposite from its end carrying the receptacle which outwardly projects ahead of the base and includes a yolk for supporting the shank of the nail during the driving procedure.

Therefore, it is among the primary objects of the present invention to provide a novel nail driver accessory which will readily and releasably hold a conventional nail onto the hammer head of a conventional hammer during the initial phase of a nailing procedure.

Another object of the present invention is to provide a novel nail driving apparatus which may be readily placed on the hammer head of a hammer so that a nail may be placed therein and initially started without the user having to hold the nail in place.

A further object of the present invention is to provide a novel nail driving apparatus for automatically centering and driving a nail during the initial nail driving procedure which is relatively inexpensive and that may be readily placed onto the hammer head as well as easily removed therefrom.

It is still a further object of the present invention to provide a novel nailing accessory which is adapted to releasably hold a nail in position during the initial stages of a nailing procedure which includes a base detachably carried on the impact hammer head of a hammer and which includes an outwardly projecting yoke portion which stabilizes the nail during the initial nailing operation.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description taken in connection with the accompanying drawings, in which:

FIG. 1 is a perspective view of the novel nail driver accessory incorporating the present invention and illustrated with the nail preparatory for assembly therewith;

FIG. 2 is a rear perspective view of the novel nail driver accessory shown in FIG. 1;

FIG. 3 is an enlarged longitudinal cross sectional view of the nail driver accessory shown in FIGS. 1 and 2 and illustrating the impact head of the hammer as well as the nail during the driving procedure.

DESCRIPTION OF PREFERRED EMBODIMENT

Referring to FIG. 1, the novel nail driving apparatus of the present invention is illustrated in the general direction of arrow 10 which includes a circular base 11 composed of a soft, pliable material such as rubber or rubber-like composition. One side of the base 11 includes a reduced portion 12 having a receptacle 13 provided therein for receiving the impact head of a conventional hammer. The other end of the base 11 is formed with a recess or opening 14 for receiving a head 15 carried on the end of a shaft 16 of a conventional nail illustrated in the general direction of arrow 17. A projection 18 outwardly extends from the front face of the base 11 and includes a yoke 20 having a central slot 21 for releasably holding the shank 16 of the nail 17. The projection 18 extends in fixed spaced relationship with respect to the front face of the base 11 a suitable distance; however, the distance is intended to be of a lesser dimension than the length of the shank 16 so that a substantial portion of the shank 16 outwardly extends from a flat surface 22 carried on the yoke 20.

Referring now to FIG. 2, it can be seen that the rear of the base 11 includes the receptacle 13 for receiving the impact head of a conventional hammer. The composition of the reduced portion 12 is pliable so that the head of the hammer may be fitted in an interference type fit with the sidewall of the receptacle whereby the device 10 may be carried thereon.

Referring now in detail to FIG. 3 it can be seen that a striking or impact head 25 of the hammer is insertably received within the receptacle 13 and that the central axis of the impact head 25 is coaxially disposed with respect to the opening or recess 14 as well as the shank 16 of the nail 17. In this manner, full force of impact is transmitted to the shank of the nail. It is to be particularly noted that a metal plate 26 forms the bottom of the receptacle 13 against which the impact head of the hammer is engaged. Preferrably, the plate 26 includes a concave surface 27 adapted to correspond to the curvature of the hammer head impact surface 28. The opposite side of the plate 26 is formed with a hemispherical or curved recess 30 adapted to bear against the head 15 of the nail 17. Furthermore, it can be seen in FIG. 3 that the plate 26 includes a projection 31 which is surrounded by the soft material of the projection 18. Thereby, stiffness is provided as well as rigidity to the projection. Once the head of the nail has been inserted through the recess or opening 14 and is in contact with the plate 26, the shank 16 rests at the bottom of the yoke 21.

In actual use, once the device 10 has been placed on the impact head of a hammer and a nail has been placed in the yoke 21 and through the opening 14 as previously described, the user may then swing the hammer so that the tip of the shank 16 lands on the spot or in the area desired. The impact force will be transmitted from the head of the hammer 25 through the plate 26 and into the nail so that the point of the shank 16 is driven into a workpiece. After the nail has been so started, the user may then tilt or jiggle the hammer so that the shank 16 disengages with the slot 21 in the yoke 20 and the head 15 is disengaged from the recess 14. In essence, the hammer head is drawn rearwardly in the direction of arrow 32 so that the projection 20 assumes the position shown in broken lines. At this time, the nail will be partially driven into the workpiece 33 so that the head of the nail will be cut out of the recess 14 and by tipping the device 10 slightly, the shank will disengage with the slot 21.

Preferrably, the material of the body, reduced portion 12 and the projection 18 is of a soft and pliable composition while the plate 26 with its extension or projection 31 is of a hard and rigid metal which is totally surrounded by the material of softer composition.

While particular embodiments of the present invention have been shown and described, it will be obvious to those skilled in the art that changes and modifications may be made without departing from this invention in its broader aspects, and therefore, the aim in the appended claims is to cover all such changes and modifications as fall within the true spirit and scope of this invention.

What is claimed is:

1. A nail driver accessory for releasably holding a nail having a shank and a head so that it may be driven into a workpiece by a hammer, the combination comprising:

a substantially L-shaped body in side elevational of soft, pliable material having a receptacle provided at one end and an opening coaxial therewith provided at its opposite end;

a projection integral with the opposite end of soft, pliable material outwardly extending from said body terminating in a yoke in spaced relationship to said body opening provided with a slot lying on the longitudinal central axis of said body opening and said receptacle;

a metal plate carried in said body jointly serving as the bottom of said receptacle and said opening so as to separate them therebetween and having a projection portion extending within and surrounded by said outwardly extending projection;

said receptacle is adapted to form fit and insertably receive and releasably engage with the conventional impact head of the hammer so that it bears against one side of said metal plate;

said body opening is adapted to insertably receive the head of a nail while the shank lies in said yoke slot so that the head of the nail bears against the other side of said metal plate from its side bearing against the impact head of the hammer;

said metal plate includes an inner surface serving as the bottom for said receptacle which is concave so as to substantially conform with the contour of the hammer impact head;

said metal plate includes an outer surface engagable with said body and having a recess therein coaxial with respect to said body opening substantially occupied by the head of the nail.

2. The invention as defined in claim 1 wherein:

said projection includes a flat frontal surface terminating in said yoke.

3. The invention as defined in claim 2 wherein:

said receptacle is defined by a rear portion of said body of reduced diameter so as to force fit with the impact head of the hammer in an interference relationship.

* * * * *